US006817372B2

(12) United States Patent
Ennals et al.

(10) Patent No.: US 6,817,372 B2
(45) Date of Patent: Nov. 16, 2004

(54) TRAY FOR A WALKER

(75) Inventors: Stella G. Ennals, 424 Leonard La., Cambridge, MD (US) 21613; James L. Marshall, Sr., Woolford, MD (US); Richard A. Loeffler, Ocean City, MD (US)

(73) Assignee: Stella G. Ennals, Cambridge, MD (US)

( * ) Notice: Subject to any disclaimer, the term of this patent is extended or adjusted under 35 U.S.C. 154(b) by 0 days.

(21) Appl. No.: 10/229,120

(22) Filed: Aug. 28, 2002

(65) Prior Publication Data

US 2004/0040589 A1 Mar. 4, 2004

(51) Int. Cl.[7] ..... A45B 3/00

(52) U.S. Cl. ..... 135/66; 135/67; 248/311.2; 108/45; 108/50.16

(58) Field of Search ..... 135/66, 67; 108/44–45, 108/50.16; 297/4–6; 280/87.021, 87.041, 641–642; 224/42.34, 926, 42.44, 521; 248/311.2

(56) References Cited

U.S. PATENT DOCUMENTS

| | | | | | |
|---|---|---|---|---|---|
| 3,163,287 | A | * | 12/1964 | Barnett | 224/540 |
| 3,957,071 | A | | 5/1976 | Kenner | |
| 4,074,683 | A | | 2/1978 | Di Chiara | |
| 4,175,769 | A | * | 11/1979 | Kazmark | 280/654 |
| 4,403,786 | A | | 9/1983 | Ulics | |
| 4,449,750 | A | | 5/1984 | Pultman | |
| 4,643,280 | A | * | 2/1987 | Hensley | 190/11 |
| 4,659,099 | A | | 4/1987 | Malone | |
| 4,708,274 | A | | 11/1987 | Roche | |
| 4,800,911 | A | | 1/1989 | Endres et al. | |
| 4,867,506 | A | * | 9/1989 | Chavez | 297/188.2 |
| 4,946,058 | A | * | 8/1990 | Stamm | 220/23.83 |
| 5,046,748 | A | * | 9/1991 | Oat-Judge | 280/47.34 |
| D324,504 | S | | 3/1992 | Olsen | |
| 5,217,032 | A | | 6/1993 | Jobst | |
| D340,012 | S | | 10/1993 | Azzarelli | |
| 5,480,079 | A | * | 1/1996 | Douglass | 224/551 |
| 5,611,270 | A | * | 3/1997 | Harrington | 100/102 |
| 5,642,748 | A | | 7/1997 | Obitts | |
| 5,662,396 | A | * | 9/1997 | Reeder et al. | 312/209 |
| 5,694,959 | A | * | 12/1997 | Hiller et al. | 135/66 |
| 5,716,063 | A | * | 2/1998 | Doyle et al. | 280/87.05 |
| 5,722,507 | A | * | 3/1998 | Kain | 182/129 |
| D423,290 | S | | 4/2000 | Green | |
| 6,296,263 | B1 | | 10/2001 | Schultz et al. | |
| 6,371,142 | B1 | * | 4/2002 | Battiston | 135/67 |

FOREIGN PATENT DOCUMENTS

| | | | |
|---|---|---|---|
| JP | 2001-231827 | * | 8/2001 |
| WO | WO 96/27359 | * | 9/1996 |

* cited by examiner

*Primary Examiner*—Winnie Yip
(74) *Attorney, Agent, or Firm*—Burns, Doane, Swecker & Mathis, L.L.P.

(57) ABSTRACT

A multipurpose carrying tray includes a housing for containing items. The housing includes a top surface and a support base wherein the top surface has a depth. A drawer is disposed within the housing below the top surface of the housing. The drawer is smaller in depth than the depth of the top surface and is disposed above the support base. At least one opening in the top surface is provided so that an item can be placed through the top surface and supported by the support base. The tray is designed to be connected to a walker, and may be designed to be removable. By having an ability to remove the tray, the fold-up portability of the walker is retained.

16 Claims, 5 Drawing Sheets

TRAY FOR A WALKER

BACKGROUND OF THE INVENTION

A. Field of the Invention

The present invention relates to a walker tray. The present invention further relates to a walker tray for a walker, and the like.

B. Description of the Related Art

Walkers are used by persons experiencing problems with their arms, legs, or hips as well as those who have suffered injury due to stroke and the like. A walker is defined as a frame device used to support someone walking. Examples of walkers include a hemi-cane and a two-handed walker.

A typical two-handed walker has a U-shaped framework which allows a person to grip each side of the frame in a semi-enclosure. To use a two-handed walker, a person must have use of both their left and right appendages to grasp both sides of the frame. The user lifts the frame, which is lightweight, and positions it to a location in front of the user. While gripping both sides of the frame, the user walks towards the frame. This procedure is repeated.

Another type of walker that is used is known as a hemi-cane. A hemi-cane is a one sided walker used for those who have lost mobility in one side of their bodies. The one sided hemi-cane has a single handle, but similarly includes a semi-enclosure for the patient. Instead of entirely enclosing the body, a hemi-cane partially encloses the side of the body which has not lost mobility.

In both the case of the two-handed walker and hemi-cane, when using the walkers, a person cannot carry additional unsteady items, without an auxiliary carrying device. For example, if a user of a hemi-cane wants to obtain a meal from the kitchen, the user has no way of carrying the meal to a table, since the only useable hand is assisting the user on the cane. This seriously detracts from the user's ability to be self-sufficient and independent. Therefore there is a need in the art to have a multipurpose tray that can be affixed to a two handed collapsible walker, hemi-cane, or the like, which allows a user to transport various items.

U.S. Pat. No. 5,217,032 relates to a tray for an invalid's walker frame. However as seen in FIG. 1, the tray comprises a planar surface with no additional compartments. Therefore, a user would have difficult time transporting other items such as a drink. U.S. Pat. No. 3,957,071 shows a similar type carrier type attachment for an invalid walker. This device also does not have an additional compartment to transport drinks and other items.

Therefore, there is a need in the art for a multipurpose device which is designed to carry food trays and beverages, as well as other items such as cell or cordless phones, pill bottles, etc. securely.

U.S. Pat. No. 5,642,748 relates to a walker tray which has recesses for holding additional items. However, the tray is permanently affixed to the walker. Therefore, if the user wants to remove the tray, the user cannot do so unless assisted by another person. This again detracts from walker's portability and the user's ability to be self-sufficient. Thus, there is a need in the art for a removable tray that can be easily detached from a walker.

In addition, the above-noted trays are designed for two-handed walkers alone. There has yet to be designed a walker that is especially designed for use for patients who have lost mobility on only one side of their bodies. Therefore, there is a need in the art for a tray for use with a one-sided walker, or hemi-cane.

BRIEF SUMMARY OF THE INVENTION

In one aspect, the present invention provides a multipurpose carrying tray. The tray includes a housing for containing items. The housing includes a top surface and a support base wherein the top surface has a depth. A drawer is disposed within the housing below the top surface of the housing. The drawer is smaller in depth than the depth of the top surface and is disposed above the support base. At least one opening in the top surface is provided so that an item can be placed through the top surface and supported by the support base.

In a further aspect, the present invention provides a walker which has an easily removable tray. The walker has a walker frame having plural legs in spaced apart relation and at least one handle portion at an upper end thereof. A removable tray is secured on the walker by first and second attachments portions. A support bar is disposed between the legs of the walker. The first attachment portion is affixed to the support bar for supporting the tray at a first end of the tray. An elastic cord is provided for securing the tray at a second end of the tray. The elastic cord extends between the legs of the walker and are attached to the legs via hooks located at ends of the elastic cord. The elastic cord is also secured around the second attachment portion.

In an additional aspect, the present invention provides a tray to be used in connection with the hemi-cane walker. An attachment device is provided for attaching the tray to the hemi-cane.

DETAILED DESCRIPTION OF THE INVENTION

Figure 1:
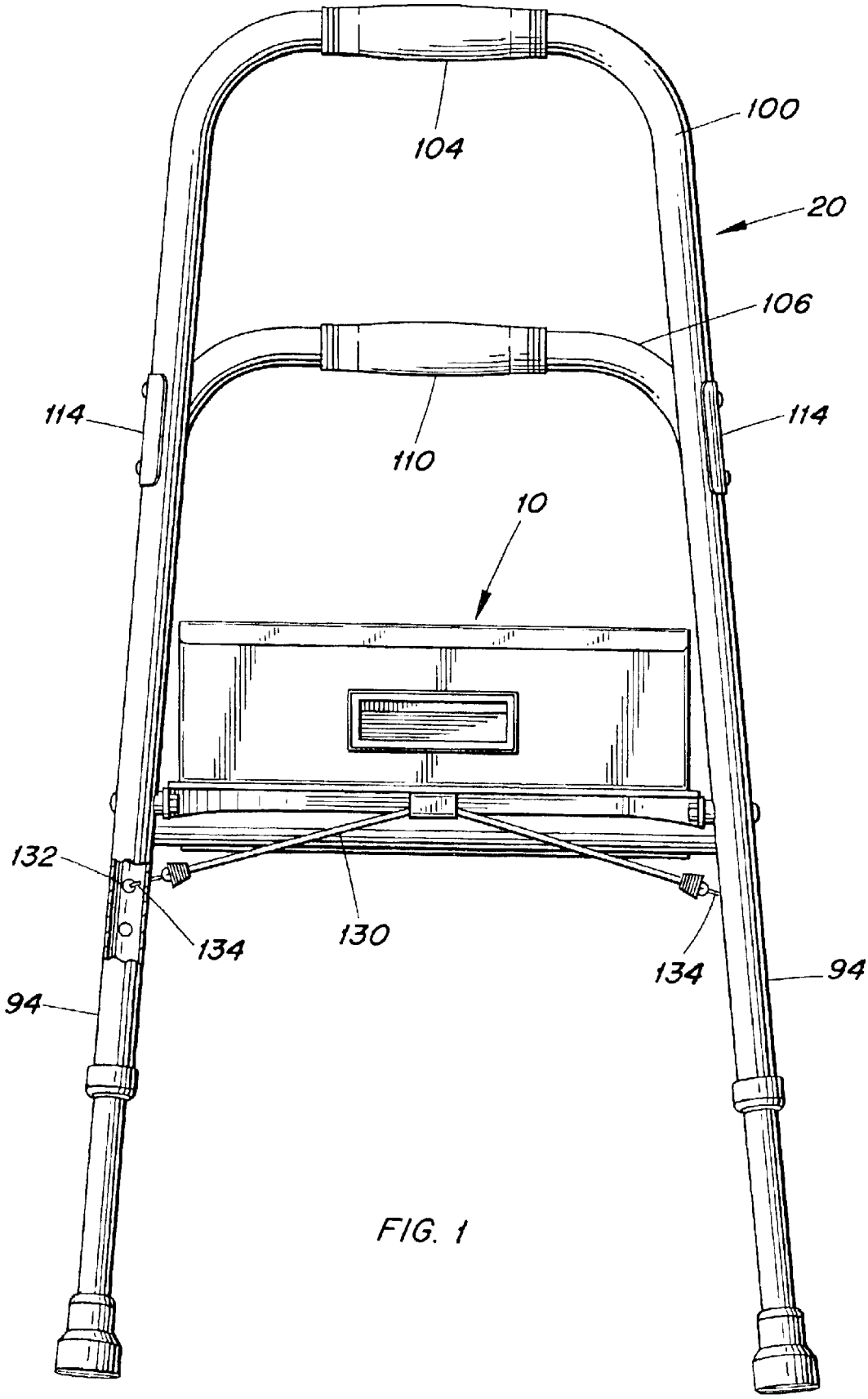
FIG. 1 is a front elevational view of a preferred embodiment of the walker tray of the present invention.

As noted above, one aspect of the present invention is to provide a tray that can be used by a person having use of only one side of his or her body. With reference to FIG. 1, the tray 10 is illustrated as it is used in connection with hemi-cane 20 according to a first embodiment of the invention. A hemi-cane walker is a one-sided walker, which accommodates patients which have restricted use of only one side of their bodies. Preferably, the hemi-cane 20 is of the folding-type so that it can be collapsed and more easily handled and stored when not in use, as is well known in the art. However, non-retractable hemi-canes are also encompassed by the scope of the present invention. While FIG. 1 illustrates tray 10 as it is used in connection with hemi-canes, it should also be understood that tray 10 may be used with other type of walkers, such as two-handed walkers, walkers with wheels, and the like.

Figure 2:
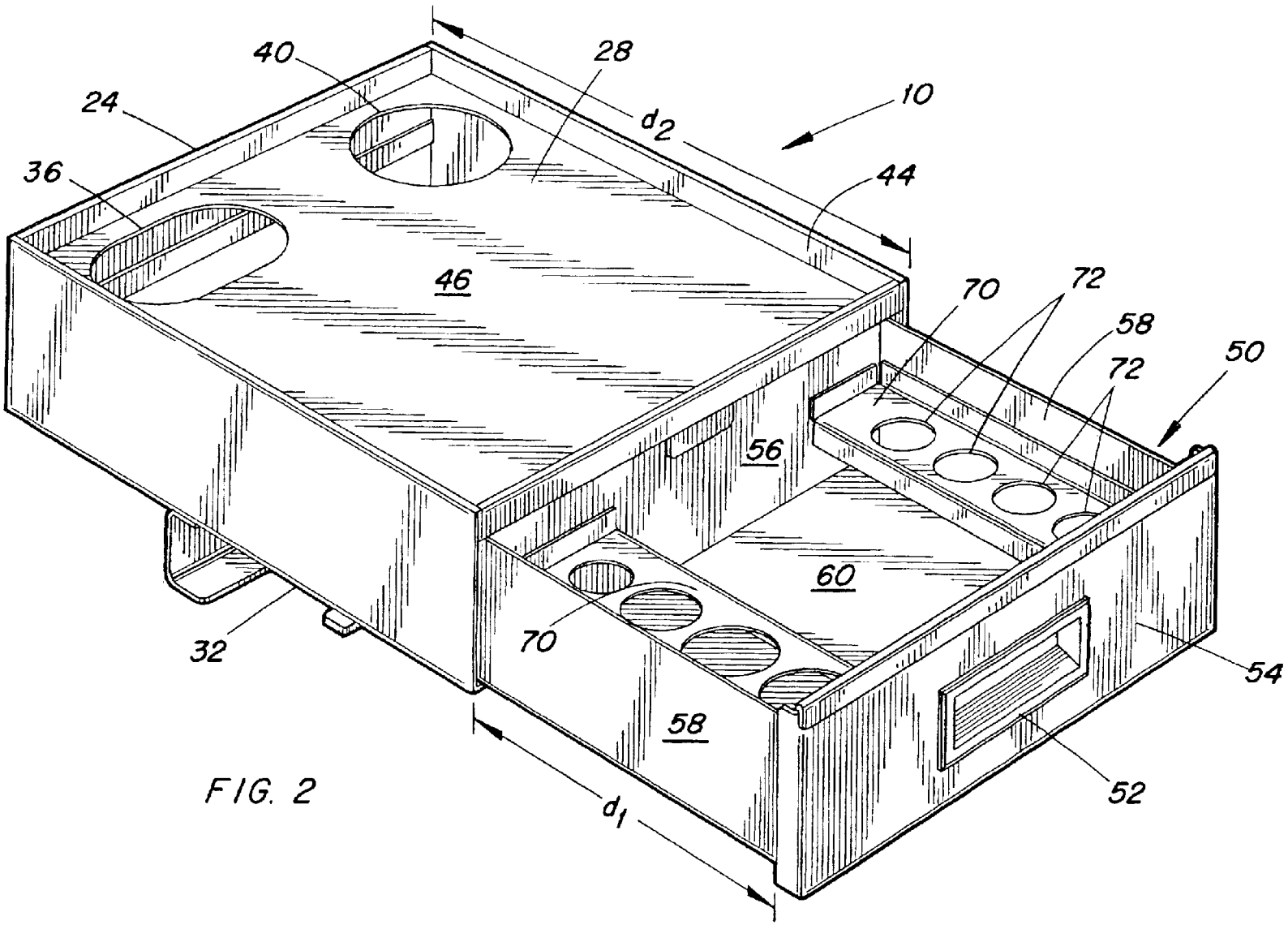
FIG. 2 is a perspective view of a preferred embodiment of the tray of the present invention, showing the drawer in an open position.
Figure 3:
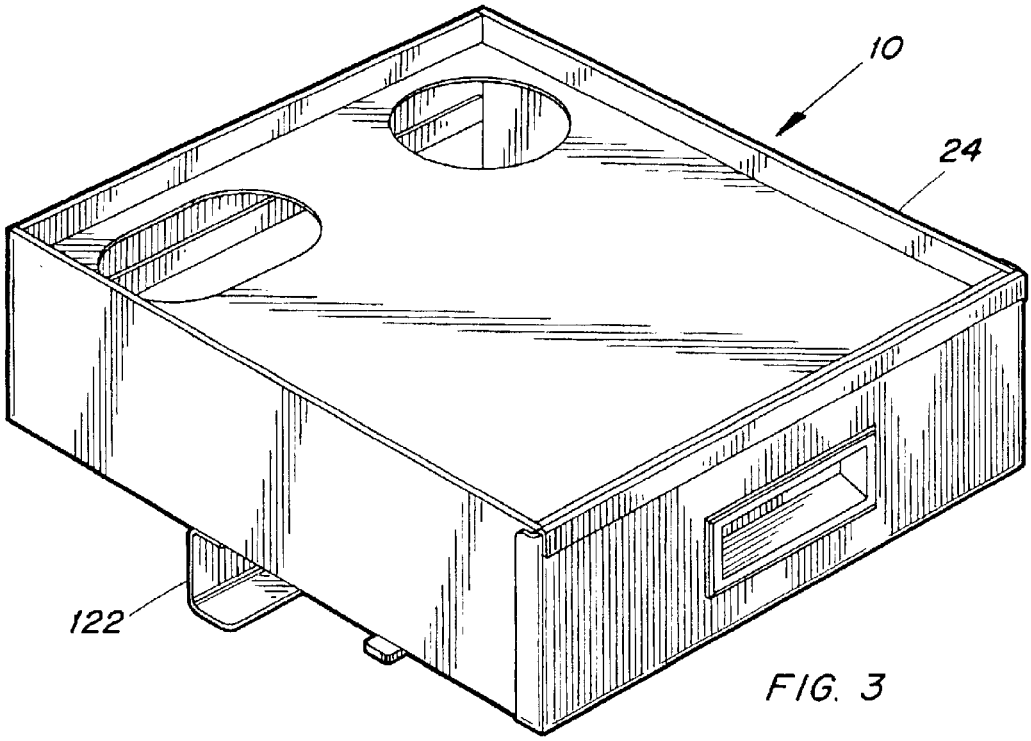
FIG. 3 is a top perspective view of a preferred embodiment of the tray of the present invention.
Figure 4:
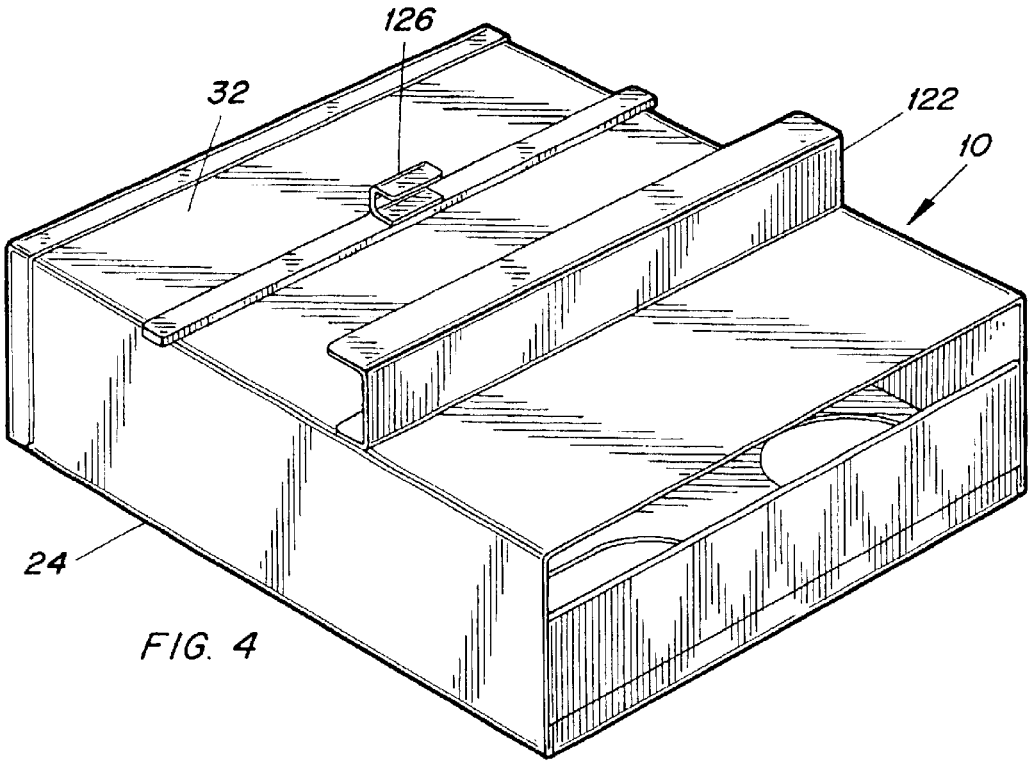
FIG. 4 is a bottom perspective view of a preferred embodiment of the tray of the present invention.

With reference to FIGS. 2–4, features of the tray 10 will be described. With reference in particular to FIG. 2, tray 10 includes a housing 24 for containing items. The housing 24 includes a top surface 28 and a support base 32. The top surface 28 includes openings 36 and 40 for placing various items. The openings 36 and 40 may be shaped to accommodate certain types of items. For example, a cell or cordless phone may be placed in opening 36 which is rectangular in shape and a drink may be placed in opening 40 which is circular in shape. While the preferred embodiment shows only two openings in the top surface 28 of housing 24, it should be understood that any number of openings with any kind of shape may be included in the surface.

Preferably, the openings 36 and 40 are disposed at a distal end of the housing 24. When items are placed through openings 36 and 40, the items rest on the support base 32 of the housing 24. This provides a secure placement for drinks and cell phones, preventing the items from tipping over upon transport.

In addition, the top surface 28 includes a portion 46 for placement of a plate, or the like. Portion 46 may include a roughened surface to help prevent an item, such as a plate, from sliding thereon. The top surface 28 may also include a flange 44 around a peripheral edge of the top surface 28. The peripheral flange 44 helps to secure an item, such as a plate, during transport, preventing the item from sliding off of portion 46. While peripheral flange 44 is shown to be continuous, it should be understood that only discrete portions of the edge of top surface 28 include a flange member.

Preferably, the tray 10 is made of plastic material, which is durable, light weight, has no sharp edges and no rust concerns. Alternatively, other materials may be used such as metal, including steel, aluminum, and the like. The tray 10 may be integrally formed or formed from separate parts.

Preferably, tray 10 also includes a drawer 50. The drawer 50 is placed between the top surface 28 and support base 32. The drawer 50 has a depth $d_1$ which is smaller than a depth $d_2$ of the top surface 28. This allows for drawer 50 to be inserted into housing 24 without coming into contact with items that have been placed in openings 36 and 40.

In the preferred embodiment, drawer 50 is of a rectangular shape including a front section 54, a rear section 56, two side sections 58 and a base 60. However, it should be understood that drawer 50 may take other shapes such as square, oval, as well as other geometrical shapes. The drawer 50 preferably includes a handle 52 for opening and closing the drawer 50 formed in the front section 54 of drawer 50.

Preferably, the drawer 50 includes a compartment for holding pills. In the preferred embodiment, the compartments are a set of plates 70. Preferably, plates 70 are affixed at each side section 58. Each plate 70 includes a plurality of openings 72 for holding pill bottles, and the like. When the pill compartments are placed to either or to the side of the drawer 50, this allows room for additional items between the compartment and the center of the drawer 50. This compartment may hold items such as a change purse, and the like. However, it should be understood that other structures may be contemplated which are capable of securely supporting pill bottles and the like. In addition, the compartments for holding the pills may be placed at different locations within the drawer 50.

Figure 5:
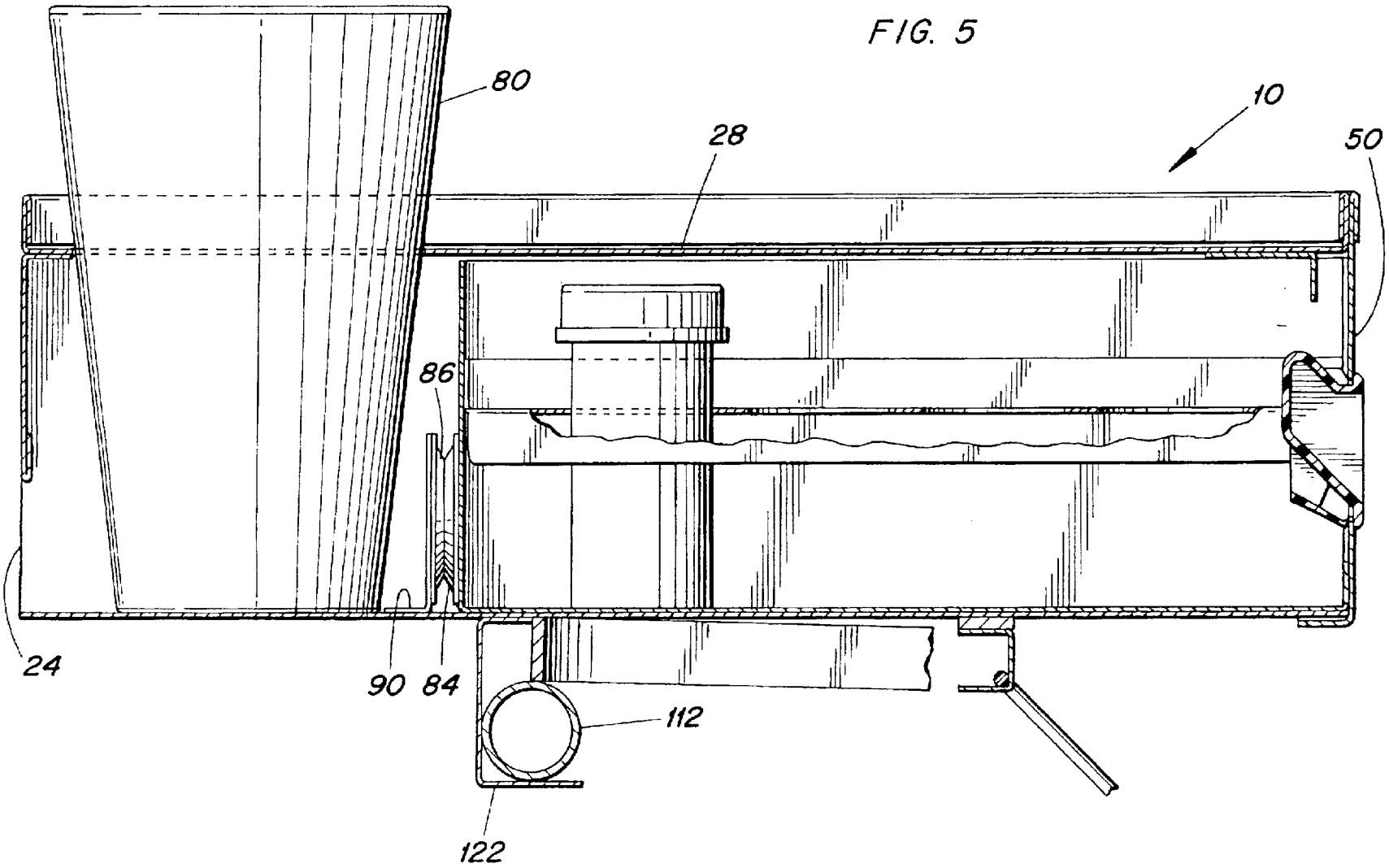
FIG. 5 is a cross sectional view of the tray of a preferred embodiment in use.

With reference to FIG. 5, a cross sectional view of the drawer 50 inside the housing 24 is disclosed. As seen in FIG. 5, the depth of drawer 50 falls short of the depth of the top surface 28, which allows drawer 50 to be completely closed without interfering with item 80 (a beverage glass or container) which is placed in one of the openings of top surface 28. Preferably, drawer 50 also includes a magnet 84 to keep the drawer 50 from sliding out when being transported. Magnet 84 secures to magnet 86 which, in the preferred embodiment, is affixed to the housing 24 by bracket 90. Alternatively, where the drawer 50 is made of plastic or the like, the drawer could be attached via Velcro. It should be understood that other attachment devices may be used, as is known in the art.

Figure 6:
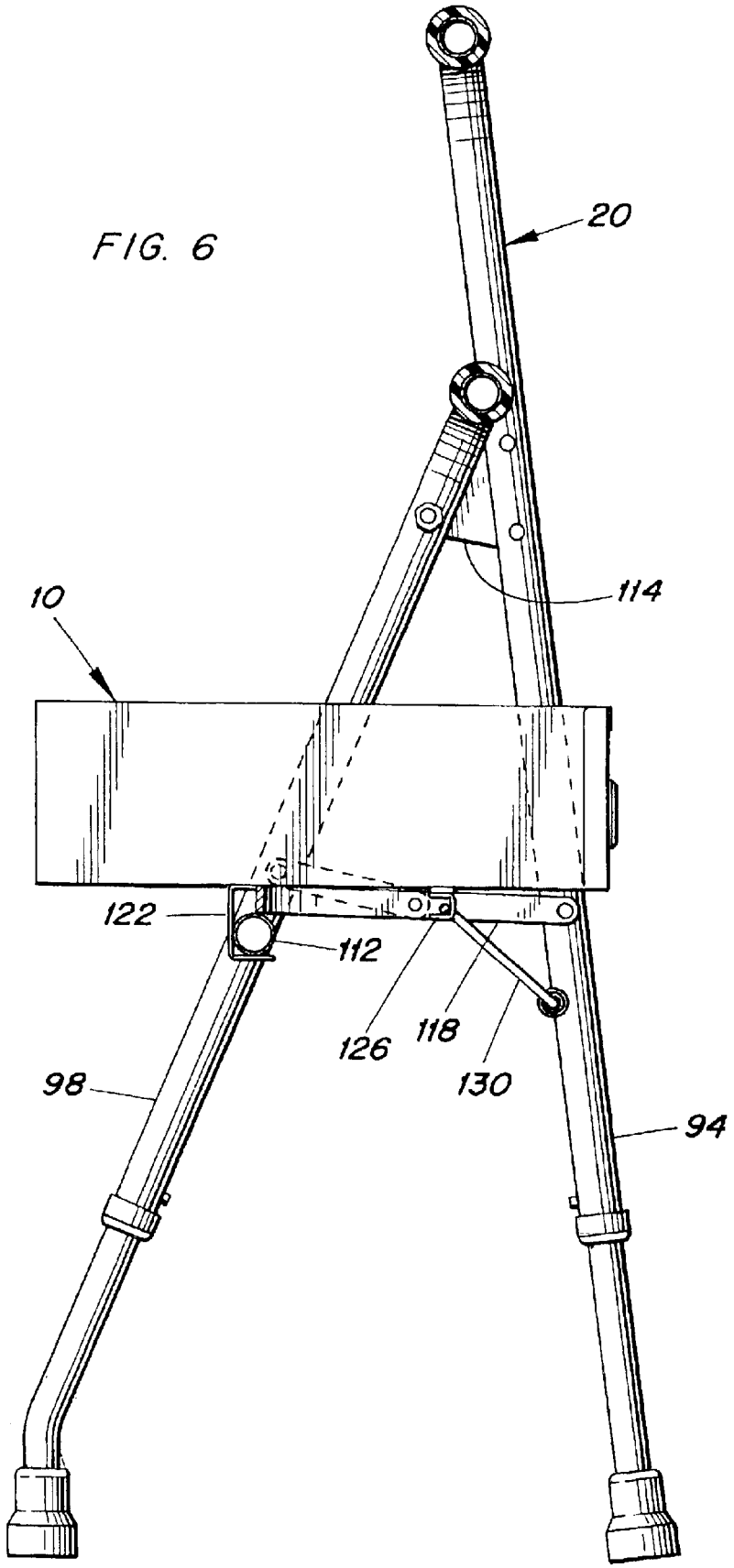
FIG. 6 is a side elevational view of a preferred embodiment of the walker of the present invention.

With reference to FIGS. 1 and 6 the construction of the hemi-cane 20 will be described in more detail. Hemi-cane 20 includes two pairs of legs, front legs 94 and rear legs 98. Front legs 94 are connected via a U-shaped section 100. U-shaped section 100 includes a handle portion 104 thereon. Similarly, rear legs 98 include a U-shaped section 106 with a handle portion 110. Rear legs 98 include a support bar 112 between its pair of legs for additional stability, as shown in FIG. 6.

Front legs 94 and rear legs 98 are connected at their top end via bracket 114. In addition, front legs 94 and rear legs 98 are also connected via a retractable bracket assembly 118. Retractable bracket assembly 118 allows the hemi-cane 20 to be moved from a first open position as shown in FIG. 6 to a retractable position in which the rear legs are disposed adjacent and substantially parallel to the front legs 94. The features of this retractable bracket assembly are well known in the art, details of which are omitted.

With reference to FIGS. 3 and 4, the attachment features of the tray 10 will be described in more detail. Preferably, the tray 10 of the present invention is removably secured on the hemi-cane 20. However, if desired, the tray 10 may be permanently affixed.

Preferably, the housing 24 includes a first attachment portion 122 and a second attachment portion 126 disposed on the support base 32 of housing 24. First attachment portion 122 is designed to secure around the support bar 112 of hemi-cane 20. This allows tray 10 to be secured on the rear legs 98 of hemi-cane 20. To provide additional support, tray 10 is also secured to front legs 94.

With reference to FIGS. 1 and 6, an elastic cord 130 is provided to secure the tray 10 to front legs 94. In particular, front legs 94 of hemi-cane 20 include apertures 132 (as shown in FIG. 1), which allow hooks 134 disposed at each end of the elastic cord to be secured therein. This allows the tray 10 to be removably secured to hemi-cane 20. In particular, if a user desires to remove the tray 10 from hemi-cane 20, a user simply unhooks elastic cord 130 from apertures 132. Once the elastic cord 130 is removed from apertures 132, the tray 10 may be rotated off of the support bar 112. While FIGS. 1 and 6 illustrate a preferred embodiment of the attachment device of the present invention, it should be understood that other attachment devices may be provided for attaching to other types of walkers.

According to the preferred embodiment of the present invention, a multipurpose tray is provided which allows users of walkers the ability to transport items within the walker. In addition, a tray is provided that may be removably detachable by a user who only has use of one side of his or her body. This provides additional independence to those who must use walkers to travel, while increasing the portability of the hemi-cane or two-handed walker. Finally, a tray is designed specifically for use with a hemi-cane walker, so that sufferers of strokes and the like, can be more self-sufficient.

Although the present invention has been described with reference to certain preferred embodiments, it is apparent that modifications and variations thereof may be made by those skilled in the art without departing from the scope of the invention as defined the following claims.

What is claimed is:

1. A tray for a walker, comprising:

a housing for containing items, said housing including a top surface and a support base, said top surface having a depth;

said housing comprising first and second attachment portions for affixing the tray to the walker a drawer disposed within said housing below said top surface of said housing, said drawer being smaller in depth than said depth of said top surface and being disposed above said support base, said drawer including at least one compartment for holding a first item, wherein the at least one compartment for securing the first item therein and preventing the first item from moving to other positions within the drawer;

at least one opening in said top surface so that a second item can be placed through said top surface and supported by said support bases;

wherein the at least one compartment is a plate disposed inside the drawer, said plate being disposed horizontally and including at least one aperture for placing the first item.

2. The tray of claim 1, wherein said top surface includes a peripheral flange around an edge of said top surface.

3. The tray of claim 1, wherein said top surface includes a peripheral flange around an entire edge of said top surface.

4. The tray of claim 1, wherein the first item may be a pill bottle.

5. The tray of claim 1, wherein said at least one plate include a plurality of holes for supporting pill bottles.

6. The tray of claim 1, wherein said at least one plate including first and second plates disposed horizontally in said drawer, said first plate disposed on a first side of said drawer, and said second plate being disposed on a second, opposite side of said drawer, each of said first and second plates including a plurality of holes for supporting pill bottles.

7. The tray of claim 6, wherein a central compartment is disposed between said first and second plates for placing additional items.

8. The tray of claim 1, wherein said first attachment portion and said second attachment portion are U-shaped brackets disposed on a bottom surface of said support base.

9. A walker with a removable tray, comprising:

a walker with a frame having plural legs in spaced apart relation and at least one handle portion at an upper end thereof;

a removable tray, said removable tray including first and second attachment portions for affixing the tray to the walker, said removable tray being completely removable from the walker such the walker can be used without the tray;

a support bar disposed between said legs, said first attachment portion being affixed to said support bar for supporting said tray at a first end of said tray;

an elastic cord for securing said tray in a substantially horizontal position for supporting an object, said elastic cord securing the tray at a second end of said tray, said elastic cord extending between the said legs of said walker and attaching to said legs via hooks located at ends of said elastic cord, said elastic cord being secured about said second attachment portion.

10. The walker of claim 9, wherein said walker is of a hemi-cane design.

11. The walker of claim 9, wherein said first and second attachment portions are U-shaped.

12. The walker of claim 9, wherein said tray includes a housing for containing items, said housing including a top surface and a support base, said top surface having a depth, a drawer disposed within said housing below said top surface of said housing, said drawer being smaller in depth than said depth of said top surface and being disposed above said support base, and at least one opening in said top surface so that a first item can be placed through said top surface and supported by said support base.

13. The walker of claim 9, wherein the walker is collapsible.

14. A hemi-cane walker and tray assembly, comprising:

a hemi-cane for users who lost mobility on one side of their body;

a removable tray secured to said hemi-cane, said tray including a compartment for securing at least one item therein; and attachment device for attaching the tray to the hemi-cane which allows users to detach the tray from the hemi-cane with one hand;

wherein the attachment device includes an elastic cord and the tray includes a first bracket for attachment to a portion of said hemi-cane and a second bracket for attachment to said elastic cord.

15. The hemi-cane walker and tray assembly of claim 14, wherein the elastic cord includes a hook disposed at each end of said elastic cord for securing the second bracket between two legs of said hemi-cane.

16. The hemi-cane walker and tray assembly of claim 15, wherein said hemi-cane includes at least one hole in each of said two legs for attaching the hooks to said hemi-cane.

* * * * *